US012716346B2

(12) United States Patent
Wiesenborn et al.

(10) Patent No.: US 12,716,346 B2
(45) Date of Patent: Aug. 25, 2026

(54) DOWNHOLE MILLING DISPLACEMENT MEASUREMENT AND CONTROL

(71) Applicant: SCHLUMBERGER TECHNOLOGY CORPORATION, Sugar Land, TX (US)

(72) Inventors: Robert Kyle Wiesenborn, Richmond, TX (US); Rodrigo Feliu, Katy, TX (US); John Lee, Sugar Land, TX (US); Gregory Giem, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/993,793

(22) PCT Filed: Jul. 13, 2023

(86) PCT No.: PCT/US2023/027641

§ 371 (c)(1),
(2) Date: Jan. 13, 2025

(87) PCT Pub. No.: WO2024/015517

PCT Pub. Date: Jan. 18, 2024

(65) Prior Publication Data

US 2026/0015932 A1 Jan. 15, 2026

Related U.S. Application Data

(60) Provisional application No. 63/368,284, filed on Jul. 13, 2022.

(51) Int. Cl.
*E21B 44/00* (2006.01)
*E21B 29/00* (2006.01)

(52) U.S. Cl.
CPC ..... *E21B 44/00* (2013.01); *E21B 29/002* (2013.01)

(58) Field of Classification Search
CPC ..... E21B 29/002
See application file for complete search history.

(56) References Cited

U.S. PATENT DOCUMENTS 5,806,404 A * 9/1998 Sher ..... B25D 16/00 74/129
7,198,119 B1 * 4/2007 Hall ..... E21B 47/12 175/57

(Continued)

OTHER PUBLICATIONS

International Search Report and Written Opinion of International Patent Application No. PCT/US2023/027641 dated on Nov. 1, 2023, 10 pages.

*Primary Examiner* — David Carroll
(74) *Attorney, Agent, or Firm* — Jeffrey D. Frantz

(57) ABSTRACT

Systems and methods are disclosed herein for performing a milling operation within a wellbore in an oil-and-gas setting. An example system can include a milling tool, which can include a cutting head, a linear actuator configured to advance the cutting head, and a linear displacement measurement sensor associated with the linear actuator. The sensor can be configured to measure linear displacement of the linear actuator. The system can also include a cable to lower the milling tool, a control unit that receives data from the sensor, and a display device that displays a visualization of the data from the sensor. The control unit can analyze the data to determine a location of a milling target, a status of the milling operation, and undesirable milling conditions down hole. The control unit can perform a remedial action, such as by turning on a pump to remove debris from the wellbore.

12 Claims, 3 Drawing Sheets

(56) References Cited

U.S. PATENT DOCUMENTS

| | | | | |
|---|---|---|---|---|
| 2016/0032711 | A1* | 2/2016 | Sheiretov | E21B 45/00 73/152.54 |
| 2016/0090787 | A1* | 3/2016 | Tegeler | H02K 41/031 175/57 |
| 2018/0106122 | A1* | 4/2018 | McAfee | E21B 43/11 |
| 2020/0055196 | A1* | 2/2020 | Halpenny | E21B 23/00 |
| 2022/0152655 | A1 | 5/2022 | Merzhaeuser | |
| 2022/0154570 | A1 | 5/2022 | Mehta | |
| 2022/0205328 | A1 | 6/2022 | Fanini et al. | |

* cited by examiner

DOWNHOLE MILLING DISPLACEMENT MEASUREMENT AND CONTROL

CROSS-REFERENCE TO RELATED APPLICATION

This application is a National Stage Entry of International Application No. PCT/US2023/027641, filed Jul. 13, 2023, claims priority to U.S. Provisional Patent Application No. 63/368,284, filed on Jul. 13, 2022, which is incorporated by reference herein.

BACKGROUND

The present disclosure is related in general to collecting measurements relating to a milling tool, such as that used in conjunction with wellbore equipment including oilfield equipment, downhole assemblies, and the like.

In some oilfield and hydrocarbon related operations, tools can be advanced into a wellbore on a wireline cable to perform various operations, such as drilling, milling, machining, and cutting, to name just a few examples. The operation of these tools often depends heavily on the depth and speed of the tool. As used herein, the term "depth" can refer to the depth of a tool or a depth of a particular portion of a cable supporting a tool, such as a connection point between the cable and tool. The term "speed" can refer to the linear speed of the tool or cable as it moves within a wellbore, typically along an axis parallel with the axis of the wellbore.

A cutting or milling operation (these terms are used synonymously throughout) may need to be performed at a particular depth in order to perform the operation according to an engineering specification. In the same way, the cutting or milling itself may need to penetrate a particular distance into a wellbore, casing, or another component within the wellbore. Similarly, the speed at which a tool is lowered or raised within a wellbore can be a critical factor in some operations. A cutting or milling operation can, for example, require a tool to be moved within the wellbore at a particular speed in order to produce an acceptable result. Traditional tools are not able to keep track of displacement in an accurate manner, nor are they able to effectively transmit information to the surface for visualization or automated control.

For example, some tools use tractor apparatus to advance a tool down a wellbore. Such tractors typically use one or more mechanical wheels to advance the tool. The tractors can track the rotation of the wheels, but that measurement is not an accurate input to determine tool depth. For example, the wheels can slide or spin within the wellbore, especially when oil, gas, or drilling fluid is in contact with the wheels.

As a result, a need exists for new and improved methods of measuring tool displacement and visualizing and controlling a milling operation using the displacement information.

It is against this backdrop that the disclosed embodiments are described herein.

SUMMARY

Systems and methods are disclosed herein for performing a milling operation within a wellbore in an oil-and-gas setting. An example system can include a milling tool and several additional components. The milling tool can include a cutting head, a linear actuator configured to advance the cutting head, and a linear displacement measurement sensor associated with the linear actuator. The tool can also include an anchor for securing the tool within the wellbore to perform the milling operation.

The linear actuator can advance one portion of the tool relative to another. For example, one portion of the tool can be associated with the anchor, such that it remains in position when the anchor is engaged. Another portion of the tool can be associated with the linear actuator, such that it moves in response to actuation from the linear actuator. One side of the linear actuator can remain fixed in that scenario, based on an interface with the anchored portion of the tool, while the other side of the linear actuator extends toward or away from the anchored portion of the tool. This can allow the tool to advance the cutting head while a portion of the tool is securely anchored within the wellbore.

The linear displacement measurement sensor can measure linear displacement of the linear actuator, such as at a millimeter-level of precision. The linear displacement measurement sensor can be a linear potentiometer, rotary potentiometer, hall effect sensor array, or magnetic field sensor in some examples. In other examples, the linear displacement measurement sensor can be a hydraulic pump sensor or a rotational sensor that measures turns of a screw of motor. The sensor can transmit data to a control unit located outside the wellbore, such as at the surface of the drilling site. The tool can utilize additional sensors as well, such as a rotary torque sensor, rotary motor position sensor, linear force sensor, anchor force sensor, or anchor position sensor.

The linear displacement measurement sensor, and any other relevant sensors, can transmit data to the control unit at the surface. The control unit can cause the data to be visually displayed on a user interface of a display device, such as a screen associated with the control unit or on a separate device such as a phone, tablet, or computer. The control unit can analyze the data to determine various things. In one example, the control unit determines the location of a milling target, such as by detecting contact between the tool and the target. The display device can display a visualization of the milling target and can also show current milling progress with respect to that target.

The control unit can also determine when a milling process has been completed or when something has gone wrong. For example, the control unit can determine that the cutting head of the tool has worn and is no longer cutting efficiently. In another example, the control unit can determine that an undesirable milling condition exists, such as the target spinning with the bit, cuttings accumulation, damage to the bit cutting structure, bit stalling, and others. The control unit can be programmed to perform a remedial action as well. For example, if the control unit determines that excess cuttings have accumulated to the point where it is impacting milling, the control unit can send an instruction to turn on a pump or bailer to remove the debris from the work area. In another example where a milling bit is stuck, the instruction can instruct the linear actuator to reverse the cutting head and then reapply it to the target.

Additionally, example systems are disclosed that include the milling tool as well as a cable configured to lower the milling tool down the wellbore and provide power, the control unit that receives data from the tool, and the display device that displays a visualization of the data. Further, example methods are disclosed for performing a milling operation. An example method can include providing a milling tool as described, receiving data collected by the linear displacement measurement sensor, and displaying information based on the collected data. The method can also include displaying visualizations of milling progress, determining that a milling operation is complete, determining that the cutting head is worn or damaged, and identifying and responding to undesirable milling conditions.

The methods herein can be incorporated into a non-transitory, computer-readable medium. The medium can include instructions that, when executed by a hardware-based processor of a computing device, performs various stages as described in the example methods herein.

This summary section is not intended to give a full description of the disclosed systems and methods.

BRIEF DESCRIPTION OF THE DRAWINGS

The embodiments of the present invention are illustrated by way of example, and not by way of limitation, in the figures of the accompanying drawings and in which like reference numerals refer to similar elements. The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
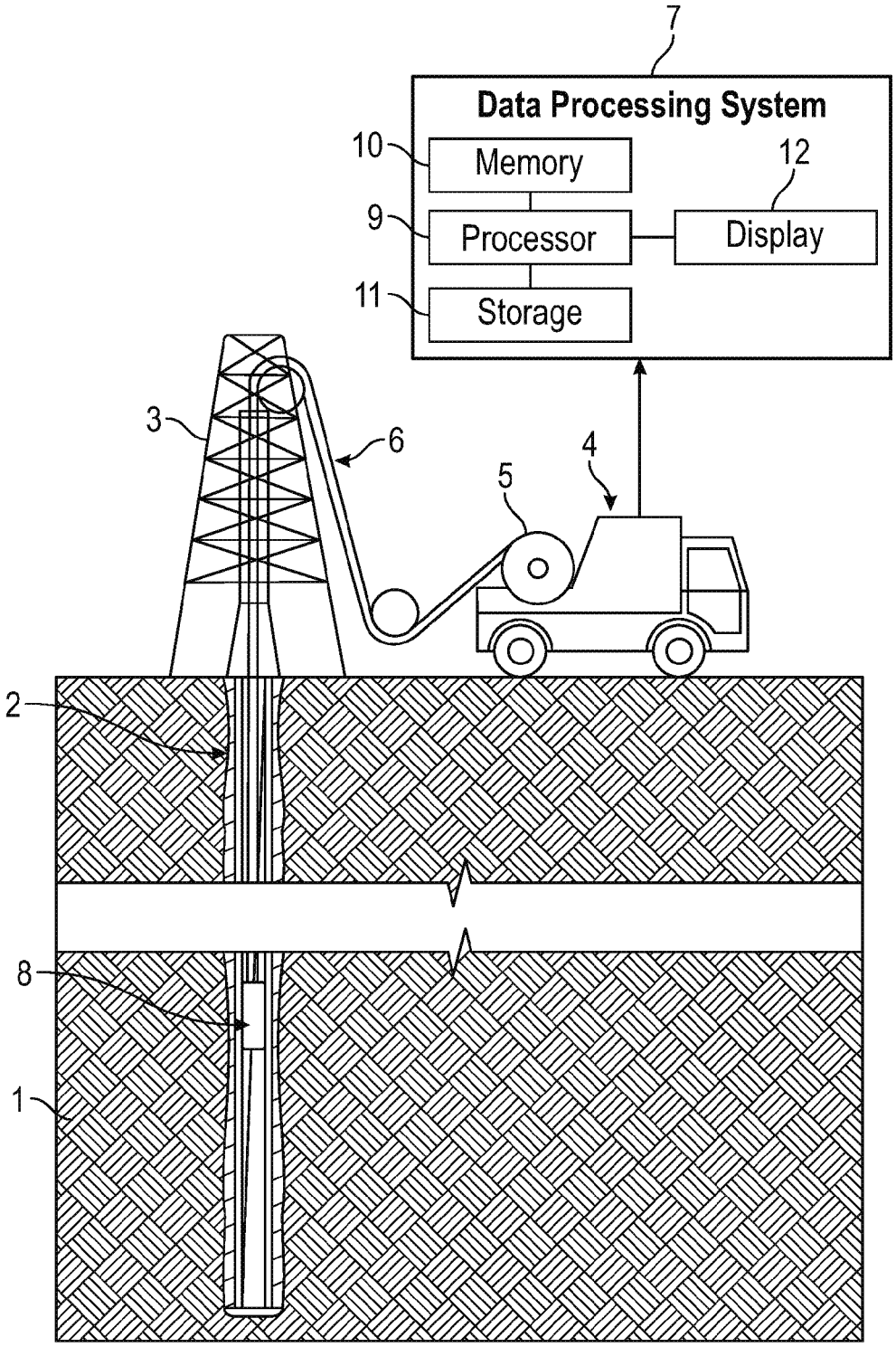
FIG. 1 provides a schematic illustration of an example system for controlling a milling operation within a wellbore.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

FIG. 1 shows an exemplary well site where a milling tool of the present invention may be utilized. A formation 1 has a drilled and completed wellbore 2. A derrick 3 above ground may be used to raise and lower components into the wellbore 2 and otherwise assist with well operations.

A wireline surface system 4 at the ground level includes a wireline logging unit, a wireline depth control system 5 having a cable 6, and a control unit 7. The cable is connected to a connection assembly 8 that may be lowered downhole. The control unit 7 includes a processor 9, memory 10, storage 11, and display 12 that may be used to display and control various operations of the wireline surface system 4, send and receive data, and store data.

The connection assembly 8 includes equipment for mechanically and electronically connecting the milling tool with the cable 6. The cable 6 includes a support wire, such as steel, to mechanically support the weight of the milling tool and communication wire to pass communications between the milling tool and the wireline surface system 4. The milling tool, as described in more detail below, is installed below the connection assembly.

The wireline surface system 4 can deploy the cable 6, which in turn lowers the connection assembly 8 and milling tool deeper downhole. Conversely, the wireline surface system 4 can retract the cable 6 and raise the milling tool and assembly, including to the surface. The cable 6 is deployed or retracted by the wireline depth control system 5, such as by unwinding or winding the cable 6 around a spool that is driven by a motor.

The wireline logging unit communicates with the control unit 7 to send and receive data and control signals. For example, the wireline logging unit can communicate data received from the milling tool to the control unit 7. The wireline logging unit likewise can communicate data and control signals received from the electronic control system 7 to the milling tool. In some examples, the wireline logging unit is part of the control unit 7. In other examples, the control unit 7 sends and receives data to and from the milling tool directly.

Although FIG. 1 shows the milling tool being operated on a cable 6, the milling tool can be attached to other types of conveyance systems, such as coil tubing. Any conveyance system can be used to mechanically support the milling tool and mechanically raise or lower it within the wellbore 2. References to a "cable" are intended to be non-limiting, instead encompassing any known conveyance system.

Figure 2:
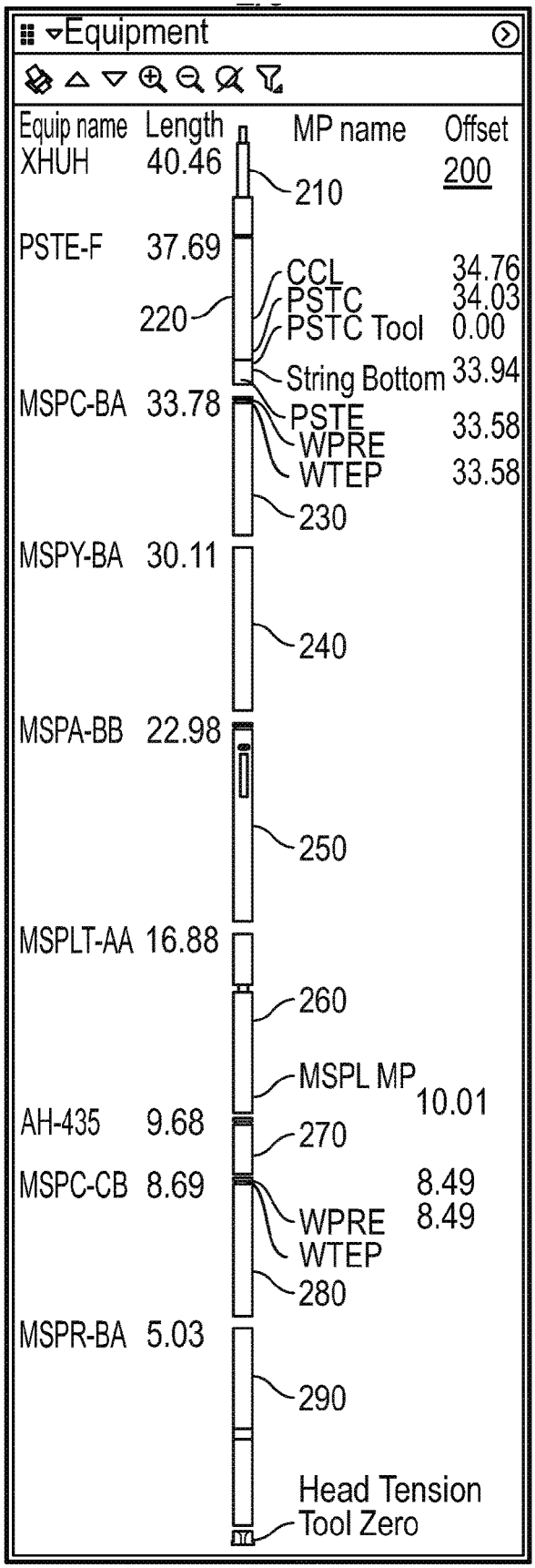
FIG. 2 provides a schematic illustration of an example milling tool as described herein.

FIG. 2 provides a schematic illustration of an example milling tool 200 as described herein. The tool 200 can include various components, some of which are shown in the schematic. For example, the tool 200 can include a head portion 210 that connects the tool 200 to a cable. The head portion 210 can include one or more tension sensors that measure cable tension. Moving down the tool 200 to the next component, the tool 200 can include a tractor cartridge 220 that can be used to move the tool 200 along a wellbore. For example, the tractor cartridge 220 can include slidable components that grip the inner surface of the wellbore and actuate to move the tool 200 as a whole.

The tool 200 can also include an electronics cartridge 230 that includes various electronic components, such as a control unit, sensors, relays, and connectors. In some examples, the electronics cartridge 230 can also include an electric motor. The tool 200 can further include a communication cartridge 240 that sends communications to the control unit 7 at the surface and can receive communications from the control unit 7, such as instructions to carry out a particular operation in the wellbore.

The tool 200 can also include an anchor module 250 that, when extended, engages one or more anchors into the sidewall of the wellbore. The anchor module 250 can be powered by an electric motor within the module, for example. The anchor module 250 can extend anchors such that they center the tool 200 within the wellbore, such as by contacting the sidewalls at two or more locations with different anchor components. In some examples, hydraulic pressure is used to extend the anchor and maintain sufficient pressure.

Additionally, the tool 200 can include a linear actuator module 260. The linear actuator module 260 can contain a linear actuator, such as a piston and rod type actuator. In such an example, the actuator of the module 260 can be actuated using hydraulic pressure to extend the rod. Other types of linear actuators can be used, however. For example, the linear actuator can be electromechanically driven, such as by driving a belt or a screw. By rotating the belt or screw, a portion of the actuator can be advanced or retracted relative to another portion of the actuator. This module 260 can also include a linear displacement measurement sensor that measure the linear displacement of the linear actuator.

As shown the linear actuator module 260 can be coupled to an adaptor head 270 that, in turn, is coupled to an electronics cartridge 280 that includes various electronic components, such as a control unit, sensors, relays, and connectors. In some examples, the electronics cartridge 230 can also include an electric motor, such as for powering a milling module 290. The milling module 290 is shown at the bottom end of the tool 200. The milling module 290 can include a rotary head (also referred to as a cutting head) that includes one or more bits for cutting into the surface of an object or other material. The rotary head can be driven by an electric motor, such as a motor in the electronics cartridge 280. Driving the rotary head can cause it to remove material from an object within the wellbore that is in contact with the milling module 290.

Various sensors can be included in the tool 200, such as sensors for temperature, fluid pressure, cutting pressure, electrical power and current, cutting head torque, rotary motor position, anchor force, anchor position, and so on. Any of all of these sensors can be configured to send data to a control unit above ground, either directly or by sending the data to a communication module on the tool 200 that communicates with the control unit.

Figure 3:
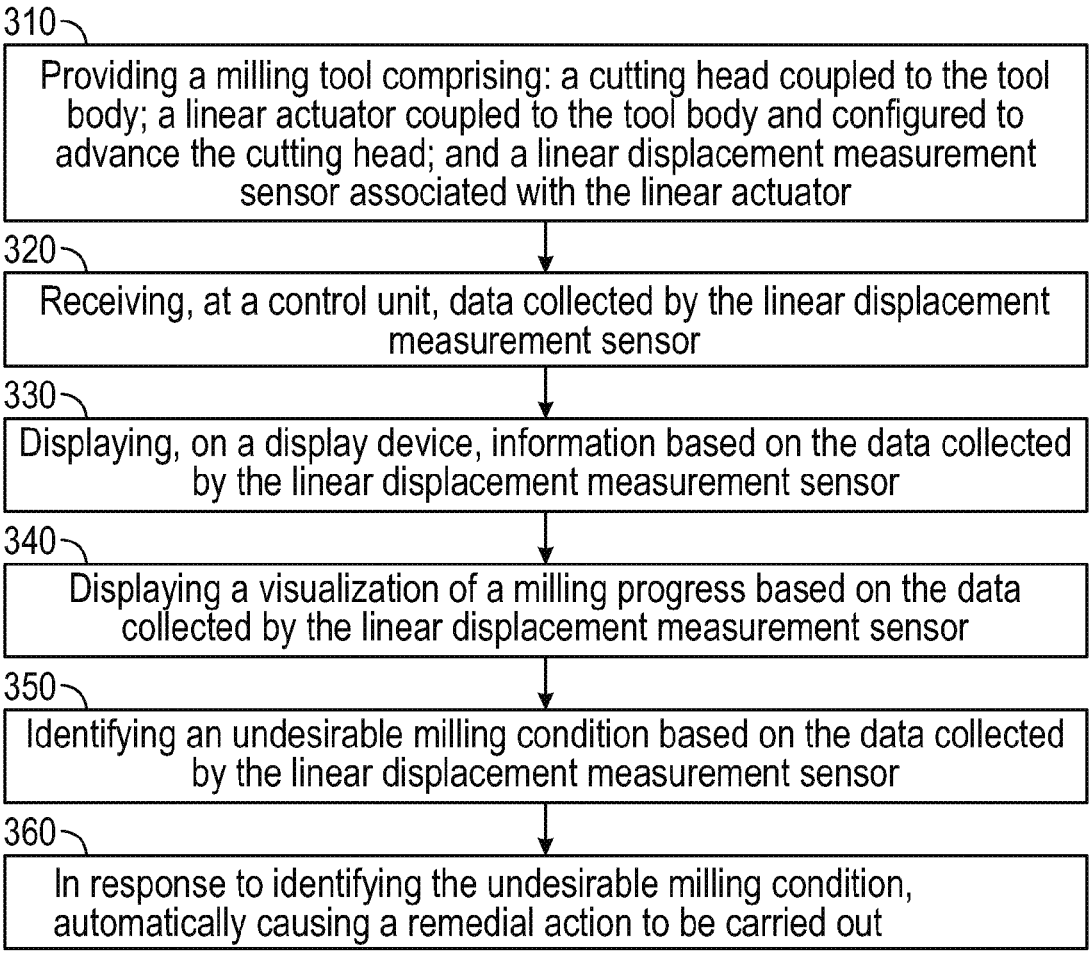
FIG. 3 provides a flow chart of an example method for performing a milling operation within a wellbore.

FIG. 3 provides a flow chart of an example method for performing a milling operation within a wellbore. Stage 310 of the method can include providing a milling tool as described herein. For example, the milling tool can include a cutting head, a linear actuator configured to advance the cutting head, and a linear displacement measurement sensor that measures linear displacement of the linear actuator. The tool can also include an anchor for securing the tool within the wellbore to perform the milling operation.

The linear actuator can advance one portion of the tool relative to another. For example, one portion of the tool can be associated with the anchor, such that it remains in position when the anchor is engaged. Another portion of the tool can be associated with the linear actuator, such that it moves in response to actuation from the linear actuator. One side of the linear actuator can remain fixed in that scenario, based on an interface with the anchored portion of the tool, while the other side of the linear actuator extends toward or away from the anchored portion of the tool. This can allow the tool to advance the cutting head while a portion of the tool is securely anchored within the wellbore.

The linear displacement measurement sensor can measure linear displacement of the linear actuator, such as at a millimeter-level of precision. The linear displacement measurement sensor can be a linear potentiometer, rotary potentiometer, hall effect sensor array, or magnetic field sensor in some examples. In other examples, the linear displacement measurement sensor can be a hydraulic pump sensor or a rotational sensor that measures turns of a screw of motor.

At stage 320, the control unit can receive data collected by the sensor. The tool can utilize additional sensors as well, such as a rotary torque sensor, rotary motor position sensor, linear force sensor, anchor force sensor, or anchor position sensor, and this information can be received at stage 320 as well.

At stage 330, the control unit can cause information to be displayed on a display device, based on the data collected from the linear displacement measurement sensor and, optionally, other sensors as well. The control unit can analyze the data to determine various things. In one example, the control unit determines the location of a milling target, such as by detecting contact between the tool and the target. The display device can display a visualization of the milling target and can also show current milling progress with respect to that target.

For example, at stage 340, the display device can display a visualization of milling progress based on the collected data. As an example, the visualization can include a diagram of the wellbore that shows a milling target, such as a plug, as well as the milling tool. The visualization can show the physical space between the milling tool and milling target, allowing an operator to advance the tool and watch the space between the tool and target shrink accordingly. In a similar way, the visualization can show the progress of an ongoing milling operation, such as by showing that the cutting surface of the milling tool is a certain depth within the milling target (or a starting point of the milling target).

At stage 350, the control unit can analyze the data to identify an undesirable milling condition. This can include, for example, analyzing data to determine that increasing pressure is being applied to the milling target via the linear actuator, but that the cutting rate of the tool is not increasing proportionately or as expected. This can indicate a worn or defective cutting blade or bit. As another example, this stage can include determining that the milling tool is stuck. In another example, this stage includes determining that milling debris is clogging the milling area.

At stage 360, the control unit can cause a remedial action to be carried out based on identifying the undesirable milling condition. For example, the remedial action can include turning on a pump that pumps out the debris collected near the milling area. Another remedial action can include notifying an operator that a replacement blade or bit is required. Another remedial action can include stopping the tool. Yet another remedial action can include reversing the cutting head of the tool, such as by retracting the linear actuator, and then extending the cutting head back to the milling target via the linear actuator.

Additional Examples

Using the linear actuator to push the milling tool has a lot of advantages compared to using a tractor—especially for short intervals machining hard materials where greater control is needed. The linear actuator can produce much larger force at the bit and the linear actuator does not use as much power to generate the push force, which means there is more power available for the rotary motor used in the milling/machining operation. Most importantly, because the linear actuator has a linear displacement measurement, it can very precisely determine the milling/machining progress, while on a tractor this is impossible because there is no indication of how much the tractor has moved.

The displacement measurement may be provided by any number of different sensors. Direct measurements include linear potentiometer, rotary potentiometer, hall effect sensor array arranged linearly or attached to a wheel, magnetic field sensor. Displacement may also be calculated using an indirect measurement by sensing the action of the actuating element including displacement of a hydraulic pump or motor and turns of a screw or motor.

In addition to being able to measure milling progress, having a displacement measurement enables decisions to be made for optimizing the milling parameters. These decisions can be made by an operator at the surface using downhole measurements including the displacement measurement communicated in real-time during milling operations using cable telemetry. Additional sensors can be included in the downhole system to capture and communicate data including milling weight-on-bit, milling torque, milling bit position and speed, hydraulic motor speed, milling motor speed, and toolstring rotation. Additionally, the system can communicate system condition measurements like hydraulic pressures, anchor force, anchor position, motor phase currents, motor temperature, and other condition-monitoring measurements. The usage of the real-time displacement measurement can enable the operator to select different weight-on-bit, torque, or feed rate settings depending on the known target material and geometry compared against the current milling progress. The displacement measurement can also be used to trigger actuation of other processes in the downhole system, for example a series of motions of the bit or activating a pump for clearing cuttings.

In order to facilitate interpretation of the milling progress measurement for the user, the surface control system can include a visual display of the milling target geometry with real-time visualization of the milling progress. The milling target and milling bit geometry can be input to the visualization interface using various formats to capture critical geometry data. Milling target material properties can also be included in the visualization interface, and the system can include a recommendation for milling parameters to be used for each stage of the milling process. The displacement measurement can also be used to identify when the milling process has been completed successfully.

In an intelligent milling system, real-time decisions can also be made by an automated controller to reduce demands and dependance on the operator. The controller can reside in the surface system and use real-time data communicated by cable telemetry, or the controller can reside in the downhole system itself. The controller can also be split into multiple processes, some of which are controlled by the surface system and some of which are controlled by the downhole system. One controller can take the form of a milling program which executes a series of pre-defined milling parameters based on the real-time measurement of milling displacement. Additional controllers can run simultaneously to respond automatically to certain other conditions, for example exceeding the maximum torque, maximum weight-on-bit, or maximum internal temperature, or upon detection of toolstring rotation detection or loss of system pressure. The controller can also include self-learning behavior with goals to optimize certain performance parameters such as rate of penetration or stall avoidance.

The intelligent milling system can also include automatic recognition of undesirable conditions. Such undesirable conditions occurring during a milling operation could include the target spinning with the bit, cuttings accumulation, damage to the bit cutting structure, bit stalling, and a variety of other conditions obvious to those skilled in the art. The undesirable conditions can be identified using one or a combination of measurements of bit torque, bit speed, force-on-bit, and linear displacement. These measurements can either be compared to a reference value based on previous experience, or they can be compared to measurements from an earlier time during the same milling operation to identify changes. Further, the system can be programmed to automatically react to these undesirable conditions, where the corrective action can include changes to milling parameters or a sequence of movements such as reversing the bit or performing a stall recovery or cuttings clearing operation.

The measurement of linear displacement allows the system to identify the milling progress if the starting position for milling is well understood. This starting position can be identified by the system as the point at which a torque increase is observed or the point at which a linear force increase is observed, or a combination of these measurements. The system can include a sequence of movements to automatically identify the starting position. Once the starting position is located, the system can also automatically perform a sequence of operations to reset the stroke of the linear actuator and anchor position to allow the entire milling process to be completed without running out of linear stroke length.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims.

What is claimed is:

1. A system for controlling a milling operating operation within a wellbore, comprising:
- a milling tool comprising:
  - a cutting head coupled to a tool body;
  - a linear actuator coupled to the tool body and configured to advance the cutting head; and
  - a linear displacement measurement sensor associated with the linear actuator, wherein the linear displacement measurement sensor is configured to measure linear displacement of the linear actuator;
- a cable configured to lower the milling tool within the wellbore;
- a control unit configured to:
  - receive data from the linear displacement measurement sensor; and
  - determine that the cutting head is worn or damaged based on the data collected by the linear displacement measurement sensor; and
- a display device configured to display a visualization of the data from the linear displacement measurement sensor.

2. The system of claim 1, wherein the control unit is configured to analyze the data to determine a location of a milling target.

3. The system of claim 1, wherein the display device is configured to display a visualization of a milling target and milling progress based on the data from the milling tool.

4. The system of claim 1, wherein the control unit is configured to determine that the milling operation is completed based on the data from the milling tool.

5. The system of claim 1, wherein the control unit is configured to identify an undesirable milling condition based on the data from the milling tool.

6. The system of claim 5, wherein in response to identifying an undesirable milling condition, the control unit is configured to automatically cause a remedial action to be carried out.

7. The system of claim 1, wherein the control unit is configured to automatically instruct the milling tool to perform a series of predefined milling procedures based on at least one of the measured linear displacement, a milling target material, and a cutting head type.

8. A method for performing a milling operation within a wellbore, comprising:
- providing a milling tool within a wellbore, the milling tool comprising:

a cutting head coupled to a tool body;

a linear actuator coupled to the tool body and configured to advance the cutting head; and a linear displacement measurement sensor associated with the linear actuator, wherein the linear displacement measurement sensor is configured to measure linear displacement of the linear actuator;

receiving, at a control unit, data collected by the linear displacement measurement sensor;

determining that the cutting head is worn or damaged based on the data collected by the linear displacement measurement sensor; and displaying, on a display device, information based on the data collected by the linear displacement measurement sensor.

9. The method of claim 8, further comprising displaying a visualization of a milling progress based on the data collected by the linear displacement measurement sensor.

10. The method of claim 8, further comprising determining that the milling operation is completed based on the data collected by the linear displacement measurement sensor.

11. The method of claim 8, further comprising identifying an undesirable milling condition based on the data collected by the linear displacement measurement sensor.

12. The method of claim 11, further comprising, in response to identifying the undesirable milling condition, automatically causing a remedial action to be carried out.

* * * * *